United States Patent [19]

Fukubayashi et al.

[11] 4,026,786

[45] May 31, 1977

[54] PREPARATION OF $PBO_2$ANODE

[75] Inventors: Haruhisa Fukubayashi; Waldemar M. Dressel, both of Rolla, Mo.

[73] Assignee: The United States of America as represented by the Secretary of the Interior, Washington, D.C.

[22] Filed: July 31, 1975

[21] Appl. No.: 601,125

[52] U.S. Cl. ..... 204/290 F; 204/57; 204/83; 204/291

[51] Int. Cl.[2] ..... C25B 1/30; C25B 11/10; C25B 11/16

[58] Field of Search ..... 204/83, 291, 290 F, 57

[56] References Cited

UNITED STATES PATENTS

| | | | |
|---|---|---|---|
| 817,419 | 4/1906 | Dieffenbach | 204/DIG. 10 |
| 1,706,951 | 3/1929 | Benner | 204/57 X |
| 1,970,804 | 8/1934 | Kerk | 204/290 F |
| 2,711,497 | 6/1955 | Ruben | 204/57 X |
| 2,872,405 | 2/1959 | Miller et al. | 204/290 F |
| 3,634,216 | 1/1972 | Gibson et al. | 204/83 |

*Primary Examiner*—F.C. Edmundson

*Attorney, Agent, or Firm*—William S. Brown; Donald A. Gardiner

[57] ABSTRACT

A method for, and product produced by, electrodeposition of lead dioxide on a substrate anode from electrolyte containing lead nitrate and free nitric acid, wherein the free nitric acid concentration in the electrolyte is maintained at about 90 to about 125 grams per liter, to substantially eliminate the concurrent electrodeposition of lead monoxide onto the substrate. Anodes so produced are useful in electrowinning processes for recovering metals from metal ores.

4 Claims, No Drawings

PREPARATION OF $PBO_2$ANODE

FIELD OF THE INVENTION

The present invention relates to the electrodeposition of metallic compounds onto another surface, and more particularly, to a method of deposition of lead dioxide onto a substrate anode in an electrolyte, and to an anode produced by this method.

DESCRIPTION OF THE PRIOR ART

With the increased interest in conservation of mineral resources, including better utilization of the mineral sources available, more efficient methods are being sought of extracting metal from lower grade ores. At the same time, increased emphasis is being placed on the reduction of the air and water pollution which many types of metal extraction processes now characteristically produce. One promising method of extraction of metals which minimizes pollution problems and at the same time promises higher efficiencies is electrowinning, the recovery of metals from ores by means of electrochemical processes.

Such electrowinning processes are well known and are presently in use. In an exemplary process, used in the electrowinning of such metals as zinc, an electrocell, which contains a lead dioxide anode, a cathode of another metal, and a zinc-acid solution electrolyte, is used to deposit zinc onto the cathode when a voltage is impressed across the electrodes.

One of the major problems in the electrowinning of metals concerns the anodes used in the electrocells. These anodes must be inert, rugged, and inexpensive. The anodes usually used for electrodeposition of metals, such as zinc and copper, consist of lead dioxide deposited on a lead alloy sheet containing silver and/or antimony. Such anodes require long break-in times, require considerable silver and/or antimony alloying agents, and react during the electrowinning process to cause lead to migrate to the metal being deposited on the cathode. Ideally, anodes should be formed from the direct deposition of lead dioxide onto an inert metal substrate, such as titanium or platinum, with titanium being preferred due to lower metal costs.

Lead dioxide has been deposited onto titanium sheets for the production of anodes used in electrocells for producing a wide variety of compounds, such as sodium chlorate, sodium hypochlorite, and sodium perchlorate. Such lead dioxide deposits require that, preceding the deposition of the lead dioxide, either the titanium surface be precoated with a conductor metal such as copper, nickel, silver, or platinum, or fluorides be used to establish a clean surface on the titanium sheet. Neither of these techniques is acceptable if the anode is to be used in the electrowinning of metals from acid solutions. Specifically, in zinc electrowinning, the use of fluorides is unsatisfactory because fluorides react with the presently used aluminum cathode starter sheets, and cause the deposited metal to stick too tightly. Moreover, precoating of the titanium sheet with copper, silver, nickel or other acid soluble material produces an anode which deteriorates and which causes unwanted metal ions to migrate to the cathode with the metal being electrodeposited.

Another problem currently encountered in the deposition of lead dioxide onto titanium substrates is the concurrent deposition of lead monoxide. Lead monoxide is converted to lead dioxide during the electrowinning process, causing the deposit to expand, and destroying its structural integrity. Further, lead monoxide is a non-conductor and thus necessitates the use of higher electrowinning voltages.

SUMMARY OF THE INVENTION

According to the invention, lead dioxide is electrodeposited onto a metal substrate anode in an electrolytic cell containing an electrolyte which includes lead nitrate and free nitric acid, wherein the free nitric acid concentration in the electrolyte is maintained at a concentration in the range of about 90 to 125 grams per liter, and preferably in the range of about 100 to 110 grams per liter. Conventional processes commonly use a free nitric acid concentration of 2 to 3 grams per liter, although free nitric acid concentrations of 5 to 20 grams per liter have been disclosed (See U.S. Pat. No. 3,463,707 issued to Gibson et al). However, it has been found that radically increasing the free nitric acid concentration to the range set forth above, contrary to the suggestions of the prior art, provides substantial advantages. Specifically, this technique permits the direct electrodeposition of lead dioxide onto a non-precoated metal substrate without the attendant electrodeposition of lead monoxide. Because of the resultant structural integrity and ability to withstand stress of anodes produced by the method of the invention, anodes so produced are particularly useful in the electrowinning of metals.

Other features and advantages of the invention will be set forth in, or will become apparent from, a detailed description of the preferred embodiments found hereinbelow.

DETAILED DESCRIPTION OF THE PREFERRED EMBODIMENTS

As noted hereinabove, the improved process of the invention makes possible the production of improved lead dioxide anodes which are particularly suited for use in electrowinning of metals, by enabling the direct electrodeposition of lead dioxide onto a suitable metal substrate, without the previously required precoating, or fluoride additives, and without attendant lead monoxide deposition. As was also noted, the improved process of the invention involves, in general terms, maintaining the concentration of the free nitric acid within the electrolyte above a specified level, preferably 100 grams per liter or greater.

The electrolyte solution used in the method of the present invention principally comprises lead nitrate and free nitric acid, and, optionally, copper nitrate and ceramic particles. It has been found that the nitric acid concentration is critical and that when the free nitric acid concentration in the electrolyte solution is maintained in the range of about 90 to about 125 grams per liter, and preferably in the range of about 100 to about 110 grams per liter, excellent lead dioxide anodes are produced. As noted, this free nitric acid concentration level is radically higher than the 2 to 3 grams per liter concentration used in most previous lead dioxide electrodeposition processes as well as the 5 to 20 gram per liter concentration referred to above. The high free nitric acid concentration provides several important advantages. For example, this concentration decreases the electrical resistance of the electrolyte, discourages the deposition of lead onto the cathode, and, perhaps most importantly, prevents concurrent electrodeposition of lead monoxide onto the substrate anode.

The electrolyte solution necessarily contains lead nitrate, from which the lead dioxide is formed and deposited onto the substrate anode. Concentration of the lead nitrate should be fairly high, in the range of about 260 to about 320 grams per liter. Strict control of the lead nitrate is not necessary, but can be used to control the grain size of the deposited lead dioxide. Specifically, in relation to the nitric acid concentration, lower lead nitrate concentrations will produce larger grain size deposits, whereas higher lead nitrate concentration will produce smaller grain size deposits.

The presence of copper nitrate in the electrolyte is not essential to the invention, but is preferred to reduce the hydrogen over-potential of the cathode. Further, the presence of copper favors better hydrogen gas evolution rather than deposition of lead on the cathode. Where copper nitrate is employed, the concentration in the electrolyte solution should be kept very low, e.g., in the order of 0.3 gram per liter.

Ceramic particles are preferably incorporated in the electrolyte solution because these particles, when suspended in the electrolyte as by constant agitation, prevent oxygen bubbles from clinging to the substrate anode during the electrolysis and consequently eliminate the formation of holes in the lead dioxide deposit. Typical ceramic particles are minus 325 mesh ceramic beads and, when employed, are used in a typical concentration range of 1 to 10 grams per liter.

The anode substrate material is preferably one which possesses good electrical conductivity, and which is inert to the conditions encountered in electrowinning solutions. Thus, such metals as platinum, titanium, and their alloys are suitable for use as the substitute anode material. The use of titanium and its alloys is preferred due to their lower costs. The substrate anode utilized in practicing the invention is typically in the form of a thin perforated sheet, of a thickness of about 0.2 inches. The sheet need not be precoated or chemically pretreated, but should be thoroughly cleaned, as by sand blasting, prior to the electrodeposition of the lead dioxide. Adhesion of the lead dioxide deposit is enhanced if the sheet is provided with a rough or pitted surface, such as is produced by conventional sand blasting techniques.

Any suitable cathode may be used which will withstand the electrolyte solution, and which exhibits suitable electrical properties. Thus, materials such as stainless steel, graphite, copper, and titanium can be utilized. Moreover, the configuration of the cathode is important only so far as it is ensured that adequate current densities are provided through the cell.

Typical operating conditions for the deposition of lead dioxide onto the preferred titanium substrate anode are a current density of 20 to 60 amps per square foot and a cell temperature of 60° to 70° centigrade. The temperature is preferably maintained above 60° C to prevent lead deposition on the cathode. The current density is preferably held within the given range to maximize current efficiencies. Cell voltages for depositing lead dioxide at a current density of 40 amps per square foot will typically be about 1.8 volts when copper nitrate is included in the electrolyte solution, and about 2.0 volts when copper nitrate is not used.

The following examples serve to illustrate, but not limit, the invention.

EXAMPLE I

A substrate anode of 99.9% titanium was prepared by perforating a 3 inch by 6 inch by .15 inch titanium sheet with various size openings. The corners and edges of the sheet were rounded and serrated. The sheet was sand blasted approximately 18 hours preceding the lead dioxide deposition, to clean and pit the sheet surfaces.

An aqueous electrolyte was prepared containing the following compounds in the concentration shown for each:

| | Grams per liter |
|---|---|
| $HNO_3$ | 100 |
| $Pb(NO_3)2$ | 320 |
| $Cu(NO_3)2$ | 0.3 |
| Minus 325 mesh ceramic beads | 5 |

The electrolyte was poured into a cell and the solution was heated and agitated. When the cell temperature reached 70° C, the substrated anode was placed between two titanium cathodes and was immersed in the electrolyte solution. Electrical connection to the anode and cathodes was made before immersion, and the current was turned on immediately after immersion to avoid titanium oxide formation. A current density of about 40 amps per square foot across the anode was provided and maintained. The electrolyte solution was constantly stirred to keep the ceramic beads in suspension and litharge (Pb0) and free nitric acid were periodically added to the electrolyte in a quantity sufficient to maintain the free nitric acid concentration at about 100 grams per liter, and the lead nitrate concentration within the range of about 175 to about 200 grams of Pb2 per liter.

At the end of 8 hours, the current was turned off and the anode removed from the cell, thoroughly washed with water and inspected. The anode was found to have a smooth, finely grained, firmly adhered layer of lead dioxide thereon of about 0.05 inches in thickness. The anode was tested in an electrolyte containing about 200 grams per liter of sulfuric acid and no metal ions, for 30 days at 40° C and 120 amps per square foot current density with a lead cathode. The anode showed no signs of deterioration.

EXAMPLE II

To determine the stability of anodes produced by the invention when used in the electrowinning of zinc, five anodes were prepared as in Example I. Five zinc electrolyte solutions, denominated A-E, were prepared, each having a sulfuric acid concentration of 200 grams per liter and zinc concentration of 65 grams per liter. The zinc concentration was controlled by feeding neutral $ZnSO_4$ solution, at a concentration of 200 grams per liter $Zn^{+2}$, to the electrolyte during the electrowinning. In each case, a cathode prepared from a pure aluminum sheet 3 inches by 6 inches by 0.05 inches was used. The anodes were thoroughly washed with water prior to immersion. In case A no other additives were introduced into the electrolyte. In case B 200 grams per liter $Mn^{+2}$ was added, and in cases C-E 200 grams per liter $Mn^{+2}$ and 10 milligrams per liter animal glue were added to approximate actual electrowinning conditions. The results of the cases are tablulated in Table 1. The lead contamination of the zinc deposit approached that obtained in normal industry practice, and on the longer run was substantially reduced. There was no measurable weight loss or gain of the anodes and no $MnO_2$ was found on the surface of the anode after zinc electrolysis, as is the case when lead silver anodes are used in industrial practice.

Table 1

| Case | Current Efficiency - % | Cell Voltage Volts | Deposition Time-Hrs. | Pb in Zn % | Additives |
|---|---|---|---|---|---|
| A | 95.0 | 3.90 | 4 | 0.005 | None |
| B | 91.2 | 3.85 | 4 | 0.004 | $Mn^{+2}$ |
| C | 93.3 | 3.87 | 4 | 0.003 | $Mn^{+2}$ |
| D | 93.0 | 3.83 | 8 | — | $Mn^{+2}$ and glue |
| E | 94.6 | 3.91 | 21 | 0.001 | $Mn^{+2}$ and glue |

EXAMPLE III

Three anodes were prepared as in Example 1 to test for stability in the electrowinning of copper. The anodes were preelectrolyzed prior to immersion in the electrolyte solution. In each case the electrolysis was carried out at 70° C, but at varying current densities, 30, 60 and 120 amps per square foot. Also, copper starting cathodes were used. The electrolytes initially contained about 100 grams per liter of $H_2SO_4$ and 100 grams per liter of $Cu^{+2}$. At the end of each test the $H_2SO_4$ and $Cu^{+2}$ concentrations were about 200 and 35 grams per liter respectively. The results are tabulated in Table 2. Again, the results showed reduced lead contamination in the deposited copper.

Table 2

| Case | Current Density A/ft² | Time-Hr. | Current Efficiency - % | Pb in Cu % |
|---|---|---|---|---|
| A | 30 | 45 | 94.3 | 0.001 |
| B | 60 | 11 | 98.3 | <0.001 |
| C* | 120 | 10 | 96.3 | <0.001 |

*Ceramic beads were added with constant agitation to avoid short circuits due to dendritic growth at this current density.

EXAMPLE IV

Three anodes were prepared as in Example I except that the free nitric acid concentration was varied from 60 to 100 grams per liter during the electrodeposition of the lead dioxide, to determine the effect of lower free nitric acid concentrations in the electrolyte during the electrodeposition. The three anodes, which were formed at acid concentrations of 60 grams per liter, 80 grams per liter, and 100 grams per liter, respectively, were tested for their approximate anode current efficiencies. The results are tabulated in Table 3. Current efficiencies of greater than 100% indicate that lead of a lower valence is being deposited, in this case as PbO. Subsequent X-ray analysis confirmed the presence of PbO in the deposits made with a free nitric acid concentration of 60 and 80 grams per liter, but no PbO was detected in the deposit made at the 100 grams per liter concentration.

Table 3

| Anode Number | $HNO_3$ Concentration GPL | Approx. Anode Current Efficiency - % |
|---|---|---|
| 1 | 60 | 140 |
| 2 | 80 | 120 |
| 3 | 100 | 100 |

Anode Nos. 1 and 3 were subsequently tested for stability in electrocells containing 200 grams per liter $H_2SO_4$ concentrations at 60 amps per square foot current densities, simulating commercial zinc electrowinning operations, except that no metal ions were introduced into solution. Anode No. 1 failed in five days due to exfoliation of the mixed $PbO$-$PbO_2$ deposit while anode No. 3 with its pure $PbO_2$ deposit showed no signs of failure after 30 days.

Although the invention has been described with respect to exemplary embodiments thereof, it will be understood that variations and modifications can be effected in these embodiments without departing from the scope or spirit of the invention.

We claim:

1. In a method of operating an electrolytic cell for electrodeposition of lead dioxide on a titanium substrate in an electrolyte which includes lead nitrate and free nitric acid to produce an anode for use in the electrowinning metals from acid solutions, the improvement comprising maintaining free nitric acid in the electrolyte at a concentration in the range of about 100 to 110 grams per liter.

2. The method as claimed in claim 1 wherein the electrolyte further includes cupric nitrate.

3. The method as claimed in claim 1 wherein the electrolyte further includes ceramic particles.

4. The method as claimed in claim 1 wherein the electrolyte is free of fluoride additives.

* * * * *